US009828865B2

(12) United States Patent
Aiello et al.

(10) Patent No.: US 9,828,865 B2
(45) Date of Patent: Nov. 28, 2017

(54) TURBOMACHINE ROTOR GROOVE

(71) Applicant: United Technologies Corporation, Hartford, CT (US)

(72) Inventors: Nicholas Aiello, New Haven, CT (US); Raji Mali, Woodbridge, CT (US)

(73) Assignee: United Technologies Corporation, Farmington, CT (US)

( * ) Notice: Subject to any disclaimer, the term of this patent is extended or adjusted under 35 U.S.C. 154(b) by 1298 days.

(21) Appl. No.: 13/627,036

(22) Filed: Sep. 26, 2012

(65) Prior Publication Data

US 2014/0086742 A1 Mar. 27, 2014

(51) Int. Cl.
*F01D 5/30* (2006.01)

(52) U.S. Cl.
CPC ..... *F01D 5/3038* (2013.01); *Y10T 29/49332* (2015.01)

(58) Field of Classification Search
CPC ..... F01D 5/3023; F01D 5/303; F01D 5/3038
See application file for complete search history.

(56) References Cited

U.S. PATENT DOCUMENTS 2,921,770 A * 1/1960 Frankel ..... 416/215
3,778,191 A 12/1973 Brockmann
4,432,697 A 2/1984 Miura et al.
4,684,326 A 8/1987 Wassell et al.
4,915,587 A 4/1990 Pisz et al.
5,018,943 A 5/1991 Corsmeier et al.
5,141,401 A * 8/1992 Juenger et al. ..... 416/219 R
5,580,218 A 12/1996 Nguyen et al.
6,302,651 B1 10/2001 Kildea et al.
7,367,778 B2 5/2008 Bachofner et al.
7,708,529 B2 5/2010 Klingels
2003/0044284 A1 3/2003 Leeke et al.
2006/0083621 A1 4/2006 Klingels
2009/0090096 A1* 4/2009 Sheridan ..... 60/226.3
2010/0124495 A1* 5/2010 Bifulco ..... 415/216.1

OTHER PUBLICATIONS

International Search Report and Written Opinion dated Dec. 6, 2013 for International Application No. PCT/US2013/059597.
International Preliminary Report on Patentability for International Application No. PCT/US2013/059597 dated Apr. 9, 2015.

* cited by examiner

*Primary Examiner* — Justin Seabe
(74) *Attorney, Agent, or Firm* — Carlson, Gaskey & Olds, P.C.

(57) ABSTRACT

An example turbomachine rotor provides a groove that is annular and is configured to receive a root of an airfoil, the groove having a radial cross-sectional area. A ratio of the radial cross-sectional area of the groove to a radial cross-sectional area of the root received within the annular groove is from 2 to 5.

20 Claims, 3 Drawing Sheets

TURBOMACHINE ROTOR GROOVE

BACKGROUND

This disclosure relates generally to a turbomachine rotor groove and, more particularly, to an annular groove that is relatively deep.

Turbomachines, such as gas turbine engines, typically include a fan section, a compression section, a combustion section, and a turbine section. Turbomachines may employ a geared architecture connecting portions of the compression section to the fan section.

Turbomachines often include rotors having annular grooves. Root sections of airfoils are received within the grooves. The root sections are held within the grooves as the rotors rotate. Axially compressive loads may be used to hold the rotors together. Rotors add weight to the turbomachine.

SUMMARY

A turbomachine rotor according to an exemplary aspect of the present disclosure includes, among other things, a rotor rotatable about an axis. The rotor provides a groove that is annular and is configured to receive a root of an airfoil. The groove has a radial cross-sectional area. A ratio of the radial cross-sectional area of the groove to a radial cross-sectional area of the root received within the annular groove is from 2 to 5.

In a further nonlimiting embodiment of the foregoing turbomachine rotor, the airfoil is within an axially rearmost airfoil array of a high-pressure compressor section of a turbomachine.

In a further nonlimiting embodiment of either of the foregoing turbomachine rotors, the turbomachine comprises a geared architecture.

In a further nonlimiting embodiment of any of the foregoing turbomachine rotors, the rotor is axially loaded.

In a further nonlimiting embodiment of any of the foregoing turbomachine rotors, the airfoil is a compressor blade.

In a further nonlimiting embodiment of any of the foregoing turbomachine rotors, the rotor has a radially innermost surface and a radial height. A radial distance between a floor of the groove and the radially innermost surface of the root is greater than the radial height of the groove.

In a further nonlimiting embodiment of any of the foregoing turbomachine rotors, a portion of the rotor that is upstream the groove is axially loaded at a position that is radially above the groove and a portion of the rotor that is downstream the groove is axially loaded at a position that is radially below the groove area In a further nonlimiting embodiment of any of the foregoing turbomachine rotors, the groove has an open area that is not occupied by the root when the root is received within the groove. The open area is greater than the radial cross-sectional area of the root.

A turbomachine rotor according to another exemplary aspect of the present disclosure includes, among other things, a groove configured to receive a root of a blade. The groove has a radial cross-section with a profile. The profile includes at least three linear sections each positioned between concave arcuate sections. The groove has an open area that is not occupied by the root when the root is received within the groove, and the open area is greater than the radial cross-section of the root.

In a further nonlimiting embodiment of the foregoing turbomachine rotor, the rotor is the axially rearmost rotor in a high-pressure compressor section of a turbomachine.

In a further nonlimiting embodiment of either of the foregoing turbomachine rotors, the turbomachine comprises a geared architecture.

In a further nonlimiting embodiment of any of the foregoing turbomachine rotors, a portion of the rotor that is upstream the groove is axially loaded at a position that is radially above the groove and a portion of the rotor that is downstream the groove is axially loaded in a position that is radially below the groove.

In a further nonlimiting embodiment of any of the foregoing turbomachine rotors, the groove has a radially outer boundary that is positioned radially at an axially narrowest area of the groove.

In a further nonlimiting embodiment of any of the foregoing turbomachine rotors, the rotor is axially loaded.

In a further nonlimiting embodiment of any of the foregoing turbomachine rotors, the blade is a compressor blade.

A method of holding a root of an airfoil within a rotor includes holding a root of an airfoil within a groove of a rotor. The groove has an axial profile with a cross-section. The profile includes at least three linear sections each positioned between concave arcuate sections.

In a further nonlimiting embodiment of the foregoing method of holding a root, the at least three linear sections are first linear sections, and the root contacts other, second linear sections when the root is held within the groove.

In a further nonlimiting embodiment of either of the foregoing methods of holding a root, the method includes loading a portion of the rotor upstream of the groove at a position that is radially above the groove, and loading a portion of the rotor that is downstream the groove at a position that is radially below the groove.

In a further nonlimiting embodiment of any of the foregoing methods of holding a root, the airfoil is a compressor blade.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
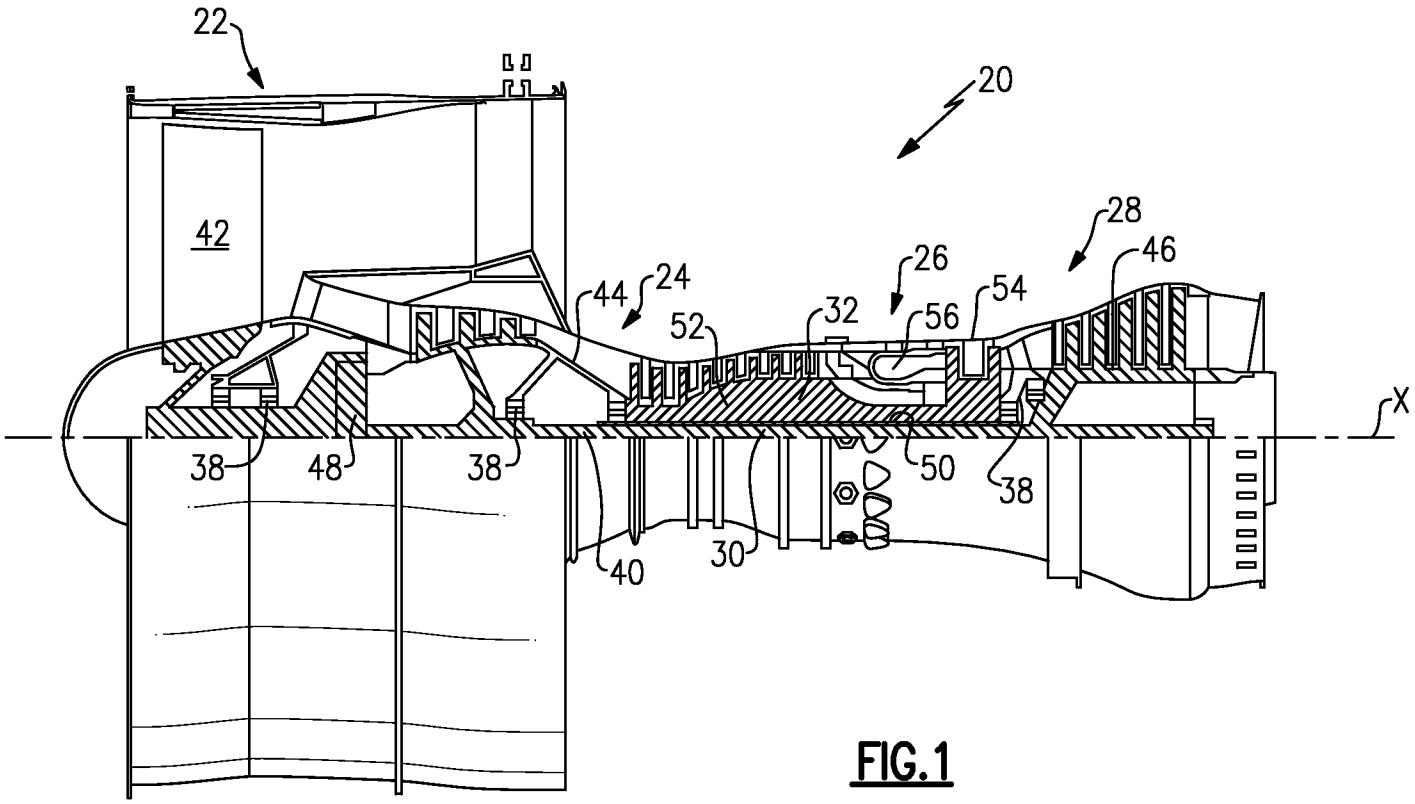
FIG. 1 shows a cross-section of an example turbomachine.

FIG. 1 schematically illustrates an example turbomachine, which is a gas turbine engine 20 in this example. The gas turbine engine 20 is a two-spool turbofan gas turbine engine that generally includes a fan section 22, a compression section 24, a combustion section 26, and a turbine section 28.

Although depicted as a two-spool turbofan gas turbine engine in the disclosed non-limiting embodiment, it should be understood that the concepts described herein are not limited to use with turbofans. That is, the teachings may be applied to other types of turbomachines and turbine engines including three-spool architectures. Further, the concepts described herein could be used in environments other than a turbomachine environment and in applications other than aerospace applications.

In the example engine 20, flow moves from the fan section 22 to a bypass flowpath. Flow from the bypass flowpath generates forward thrust. The compression section 24 drives air along a core flowpath. Compressed air from the compression section 24 communicates through the combustion section 26. The products of combustion expand through the turbine section 28.

The example engine 20 generally includes a low-speed spool 30 and a high-speed spool 32 mounted for rotation about an engine central axis X. The low-speed spool 30 and the high-speed spool 32 are rotatably supported by several bearing systems 38. It should be understood that various bearing systems 38 at various locations may alternatively, or additionally, be provided.

The low-speed spool 30 generally includes a shaft 40 that interconnects a fan 42, a low-pressure compressor 44, and a low-pressure turbine 46. The shaft 40 is connected to the fan 42 through a geared architecture 48 to drive the fan 42 at a lower speed than the low-speed spool 30.

The high-speed spool 32 includes a shaft 50 that interconnects a high-pressure compressor 52 and high-pressure turbine 54.

The shaft 40 and the shaft 50 are concentric and rotate via bearing systems 38 about the engine central longitudinal axis A, which is collinear with the longitudinal axes of the shaft 40 and the shaft 50.

The combustion section 26 includes a circumferentially distributed array of combustors 56 generally arranged axially between the high-pressure compressor 52 and the high-pressure turbine 54.

In some non-limiting examples, the engine 20 is a high-bypass geared aircraft engine. In a further example, the engine 20 bypass ratio is greater than about six (6 to 1).

The geared architecture 48 of the example engine 20 includes an epicyclic gear train, such as a planetary gear system or other gear system. The example epicyclic gear train has a gear reduction ratio of greater than about 2.3 (2.3 to 1).

The low-pressure turbine 46 pressure ratio is pressure measured prior to inlet of low-pressure turbine 46 as related to the pressure at the outlet of the low-pressure turbine 46 prior to an exhaust nozzle of the engine 20. In one non-limiting embodiment, the bypass ratio of the engine 20 is greater than about ten (10 to 1), the fan diameter is significantly larger than that of the low pressure compressor 44, and the low-pressure turbine 46 has a pressure ratio that is greater than about 5 (5 to 1). The geared architecture 48 of this embodiment is an epicyclic gear train with a gear reduction ratio of greater than about 2.5 (2.5 to 1). It should be understood, however, that the above parameters are only exemplary of one embodiment of a geared architecture engine and that the present disclosure is applicable to other gas turbine engines including direct drive turbofans.

In this embodiment of the example engine 20, a significant amount of thrust is provided by the bypass flow B due to the high bypass ratio. The fan section 22 of the engine 20 is designed for a particular flight condition—typically cruise at about 0.8 Mach and about 35,000 feet. This flight condition, with the engine 20 at its best fuel consumption, is also known as "Bucket Cruise" Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example engine 20 is less than 1.45 (1.45 to 1).

Low Corrected Fan Tip Speed is the actual fan tip speed divided by an industry standard temperature correction of Temperature divided by 518.7^0.5. That is, [(Tram° R)/(518.7° R)] 0.5. The Temperature represents the ambient temperature in degrees Rankine. The Low Corrected Fan Tip Speed according to one non-limiting embodiment of the example engine 20 is less than about 1150 fps (351 m/s). The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

Figure 2:
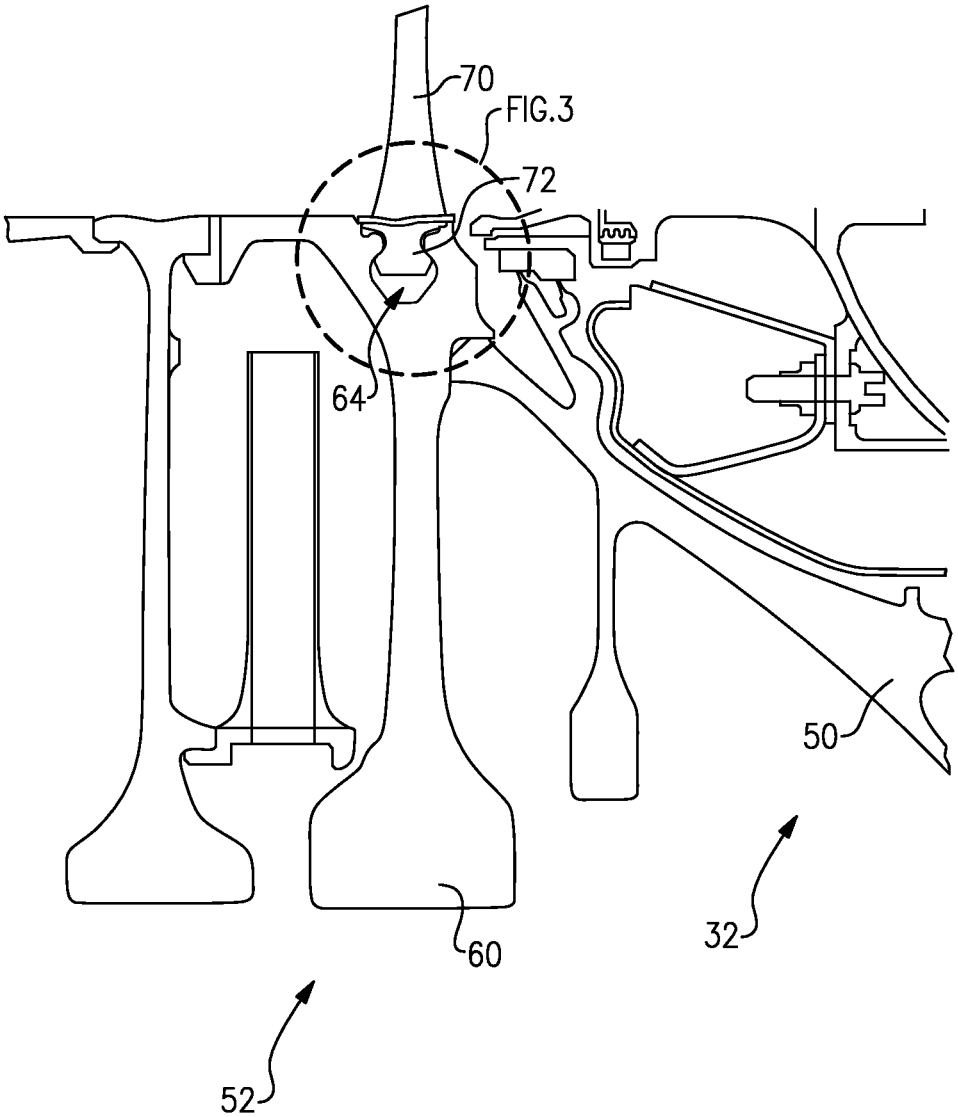
FIG. 2 shows a close-up view of aft stages of a high-pressure compressor section of the turbomachine of FIG. 1.
Figure 3:
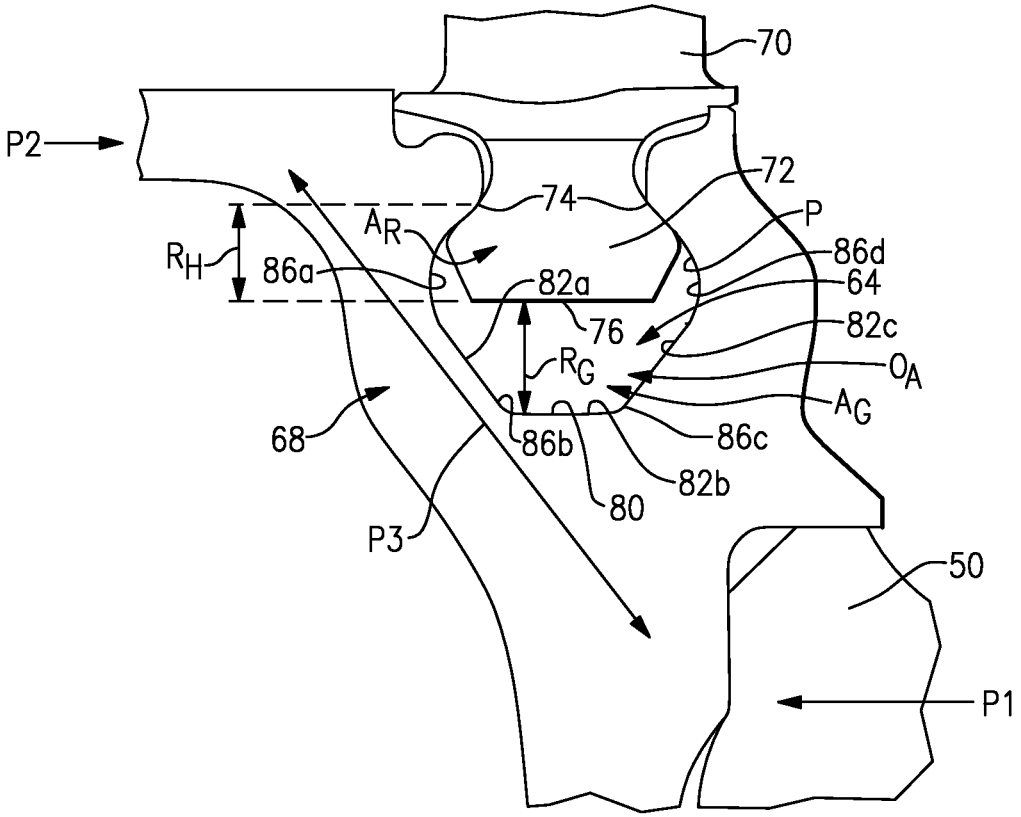
FIG. 3 shows a close up view of Area 3 in FIG. 2.

Referring to FIGS. 2 and 3 with continuing reference to FIG. 1, the high-pressure compressor section 52 includes a rotor 60 having an annular groove 64 extending about the axis X. The example rotor 60 is a tie shaft rotor that is axially clamped. The high-speed shaft 50 exerts an axially compressive load on the rotor 60 along the path P1. An opposing axial side of the rotor 60 is axially loaded along path P2. The path P1 is opposite the path P2. The load path P1 is primarily radially below the groove 64, and the load path P2 is primarily radially above the groove 64. The load is transmitted through the rotor 60 generally along load path P3, which extends more through an annular arm 68 of the rotor 60 than through the groove 64.

An airfoil 70 of the high-pressure compressor section 52 has a root 72 that is received within the groove 64. The rotor 60 rotates during operation of the engine 20 to rotate the airfoil 70 (and other airfoils) to provide a compressive force to flow that is moving through high-pressure compressor section 52. The root 72 is held within the groove 64 during operation. The airfoil 70 is the axially rearmost airfoil of the high-pressure compressor 52 in this example.

The groove 64 has a radial cross-sectional area $A_G$. The groove 64, in this example, is generally defined as being radially within the points 74. A radially outer boundary of the groove 64 is radially aligned with the points 74. The points 74 are located where the groove 64 is axially narrowest.

The root 72 has a radial cross-sectional area $A_R$, which is generally the radial cross-sectional area of the portions of the airfoil 70 that are radially within the points 74. These portions are considered received within the groove 64. In this example, a ratio of the radial cross-sectional area $A_G$ of the groove 64 to the radial cross-sectional $A_R$ of the root 72 is from 2 to 5.

The groove 64 has an open area $O_A$, which is the area of the groove 64 that is not occupied by the root 72 when the root 72 is received within the groove 64. The open area $O_A$ is essentially the area $A_R$ subtracted from the area $A_G$.

The example groove 64 has a radial profile P. In this example, the profile P includes three substantially linear sections 82*a*, 82*b*, and 82*c*; which are each positioned between arcuate sections 86*a*, 86*b*, 86*c*, and 86*d*. The arcuate sections 86*a*-86*d* are concave in this example.

The root 72 has a radially innermost surface 76. The groove 64 has a floor 80. A distance $R_G$ is a distance between the radially innermost surface 76 and the floor 80 when the root 72 is received within the groove 64. The root 72 has a root height $R_H$, which is the radial distance between the points 74 and the surface 76. The root height $R_H$ is less than the distance $R_G$.

Features of the disclosed examples include a turbomachine rotor having a deeper groove than the grooves of the prior art. The load path through the rotor is positioned primarily outside the groove.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A turbomachine assembly, comprising:

a rotor rotatable about an axis, the rotor providing a groove that is annular and is configured to receive a root of an airfoil, the groove having a radial cross-sectional area, wherein a ratio of the radial cross-sectional area of the groove to a radial cross-sectional area of the root received within the annular groove is from 2 to 5.

2. The turbomachine assembly of claim 1, further comprising an airfoil, wherein the airfoil is within an axially rearmost airfoil array of a high-pressure compressor section of a turbomachine.

3. The turbomachine assembly of claim 2, wherein the turbomachine comprises a geared architecture.

4. The turbomachine assembly of claim 1, wherein the rotor is axially loaded.

5. The turbomachine assembly of claim 1, further comprising an airfoil, wherein the airfoil is a compressor blade.

6. The turbomachine assembly of claim 1, wherein the root has a radially innermost surface and a radial height, and a radial distance between a floor of the groove and the radially innermost surface of the root is greater than the radial height of the root.

7. The turbomachine assembly of claim 1, wherein a portion of the rotor that is upstream the groove is axially loaded at a position that is radially above the groove and a portion of the rotor that is downstream the groove is axially loaded at a position that is radially below the groove.

8. The turbomachine assembly of claim 1, wherein the groove has an open area that is not occupied by the root when the root is received within the groove, and the open area is greater than the radial cross-sectional area of the root.

9. The turbomachine assembly of claim 1, wherein the groove has a radially outer boundary that is positioned radially at an axially narrowest area of the groove.

10. A turbomachine assembly, comprising:

a groove configured to receive a root of a blade, the groove having a radial cross-section with a profile, wherein the profile includes at least three linear sections each positioned between concave arcuate sections, wherein the groove has an open area that is not occupied by the root when the root is received within the groove, and the open area is greater than the radial cross-section of the root, wherein a ratio of the radial cross-sectional area of the groove to a radial cross-sectional area of the root received within the annular groove is from 2 to 5.

11. The turbomachine assembly of claim 10, further comprising a high pressure compressor section of a turbomachine, wherein the rotor is the axially rearmost rotor in the high-pressure compressor section of a turbomachine.

12. The turbomachine assembly of claim 11, further comprising a geared architecture, wherein the turbomachine comprises the geared architecture.

13. The turbomachine assembly of claim 10, wherein a portion of the rotor that is upstream the groove is axially loaded at a position that is radially above the groove and a portion of the rotor that is downstream the groove is axially loaded at a position that is radially below the groove.

14. The turbomachine assembly of claim 10, wherein the groove has a radially outer boundary that is positioned radially at an axially narrowest area of the groove.

15. The turbomachine assembly of claim 10, wherein the rotor is axially loaded.

16. The turbomachine assembly of claim 10, wherein the blade is a compressor blade.

17. A method of holding a root of a blade within a rotor, comprising:

holding a root of an airfoil within a groove of a rotor, wherein the groove has an axial profile with a cross-section, wherein the profile includes at least three linear sections each positioned between concave arcuate sections, wherein a ratio of the radial cross-sectional area of the groove to a radial cross-sectional area of the root received within the annular groove is from 2to 5.

18. The method of claim 17, wherein the at least three linear sections are first linear sections, and the root contacts other, second linear sections when the root is held within the groove.

19. The method of claim 17, including loading a portion of the rotor upstream the groove at a position that is radially above the groove, and loading a portion of the rotor that is downstream the groove at a position that is radially below the groove.

20. The method of claim 17, wherein the airfoil is a compressor blade.

* * * * *